US006204239B1

(12) United States Patent
Beagle et al.

(10) Patent No.: US 6,204,239 B1
(45) **Date of Patent: *Mar. 20, 2001**

(54) FABRIC CLEANING COMPOSITION CONTAINING ZEOLITE

(75) Inventors: Charles Beagle, South Plainfield; Richard Adams, Monmouth Junction; David Beck, Princeton Junction, all of NJ (US)

(73) Assignee: Colgate-Palmolive, Inc., Piscataway, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/449,302

(22) Filed: Nov. 24, 1999

(51) Int. Cl.[7] ..... C11D 3/08; C11D 1/831; C11D 3/37

(52) U.S. Cl. ..... 510/507; 510/320; 510/323; 510/349; 510/351; 510/356; 510/357; 510/361; 510/511

(58) Field of Search ..... 510/299, 300, 510/320, 323, 347, 349, 351, 356, 357, 361, 507, 509, 511

(56) References Cited

U.S. PATENT DOCUMENTS

| | | | | |
|---|---|---|---|---|
| 4,115,292 | * | 9/1978 | Richardson et al. | 252/90 |
| 4,176,079 | * | 11/1979 | Guerry et al. | 252/90 |
| 5,431,846 | * | 7/1995 | Christopher et al. | 252/174.24 |
| 5,583,098 | * | 12/1996 | Boskamp et al. | 510/351 |
| 5,698,511 | * | 12/1997 | Scherr et al. | 510/452 |
| 5,723,427 | * | 3/1998 | Scherr et al. | 510/361 |
| 5,863,887 | * | 1/1999 | Gillette | 510/520 |
| 6,046,149 | * | 4/2000 | Sorrie et al. | 510/320 |
| 6,063,747 | * | 5/2000 | Warwick | 510/224 |
| 6,069,124 | * | 5/2000 | Appel et al. | 510/438 |
| 6,093,690 | * | 7/2000 | Chapman | 510/444 |

FOREIGN PATENT DOCUMENTS

| | | | | |
|---|---|---|---|---|
| 0 657 527 A1 | * | 6/1995 | (EP) | C11D/3/39 |

* cited by examiner

*Primary Examiner*—Yogendra Gupta
*Assistant Examiner*—Christine Ingersoll
(74) *Attorney, Agent, or Firm*—Richard E. Nanfeldt

(57) ABSTRACT

The present invention relates to a composition containing zeolite, ethoxylated nonionic surfactant and an alkali metal carbonate.

7 Claims, No Drawings

FABRIC CLEANING COMPOSITION CONTAINING ZEOLITE

FIELD OF THE INVENTION

The present invention relates to a free flowing granular cleaning composition for use in fabric care, wherein the composition contains a nonionic surfactant and an A, or MAP type zeolite having a particle size of 2.0 to 4.2 microns, single crystal or an agglomeration of crystallites, pore diameter of 300 to 4000 nanometers, porosity of at least 1.1 cc/gram.

BACKGROUND OF THE INVENTION

In recent years the use of zeolite in fabric cleaning compositions as a replacement for phosphate as a detergent builder has increased because of the ability of the zeolite (crystalline alkali metal aluminosilicate) to sequester calcium ions from the aqueous wash solution.

More recently the use of the traditional Zeolite A has been replaced by the use of zeolite MAP (maximum aluminum zeolite P which has a silicon to aluminum ratio of less than 1.33).

Zeolite MAP has been previously disclosed in the literature. EP384070A discloses the use of zeolite MAP in a cleaning composition. EP0448297A, EP0502675A, EP0533392B1 and EP0695341B1 teaches the use of zeolite MAP in combination with a bleach system for use in cleaning compositions. PCT WO97/34979 also teaches the use of zeolite MAP in combination with a bleaching system. U.S. Pat. Nos. 5,238,594; 5,259,981; 5,259,982 and 5,498,342 are also directed to cleaning compositions containing Zeolite MAP.

PCT Wo94/28109, EP0714432B1 and U.S. Pat. Nos. 5,490,954 and 5,518,649 teach cleaning compositions using zeolite MAP in combination with high levels of anionic surfactant as well as salts of fatty acids.

The aforementioned patents fail to provide a bleach free cleaning composition which has a low foam profile of less than 4 inches such that the cleaning composition can be used in either a front or top load washing machine.

SUMMARY OF THE INVENTION

The present invention relates to a free flowing granular, low foaming fabric cleaning composition which comprises an A, or MAP type zeolite having a particle size of 2.0 to 4.2 microns as measured on a sedigraph, single crystal or an agglomeration of crystallites, pore diameter of 300 to 4000 nanometers, porosity of at least 1.1 cc/gram, a nonionic surfactant, less than 10.0 wt. % of an anionic surfactant, a polyacrylate polymer, at least one nonphosphate supplemental builder which is not a zeolite and enzymes.

An object of the instant invention is to provide a free flowing granular, low foaming fabric cleaning composition which has a foam height at the end of the wash cycle in a top load washing machine at a dose level of 92 ml of less than 4 inches.

DESCRIPTION OF THE PREFERRED EMBODIMENTS

The present invention relates to a free flowing granular, low foaming fabric cleaning composition having a bulk density of 0.4 to 0.85, more preferably 0.60 to 0.65 grams/cc which comprises approximately by weight:

(a) 5% to 20%, more preferably 7% to 11% of an ethoxylated nonionic surfactant;

(b) 2.5% to 30%, more preferably 12% to 18% of a zeolite on active basis or express as anhydrosis zeolite having a silicon to aluminum weight ratio of less than 1.33 and having a particle size of 2.0 to 4.2 microns (sedigraph), single crystal or an agglomeration of crystallites, pore diameter of 300 to 4000 nanometers, porosity of at least 1.1 cc/gram;

(c) 20% to 40%, preferably 32% to 38% of a supplemental detergent builder salt such as an alkali metal carbonate such as sodium carbonate;

(d) 0 to 10%, more preferably 0.5% to 6% of a sulfate or sulfonate anionic surfactant;

(e) 0.5% to 5.0%, more preferably 1.0% to 3.0% of a polyacrylate type polymer which functions as an agglomerating aid as well as a chelating agent for calcium and/or magnesium ions as well as an antire-deposition agent;

(f) 0.5% to 35%, more preferably 15% to 25% of sodium sulfate;

(g) 0.5% to 7%, more preferably 1 % to 6% of an alkali metal silicate such as sodium silicate or potassium silicate; and (h) 0 to 3%, more preferably 0.05% to 1.5% of at least one enzyme.

The present invention also relates to a composition particle having a size of 325 to 475 microns and having a bulk density of 0.75 to 0.85 grams/cc comprising approximately by weight:

(a) 5% to 60%, more preferably 10% to 45% of a zeolite having a silicon to aluminum ratio of less than 1.33 and having a particle size of 2.5 to 3.2 microns, a pore size of 350 to 600 nanometers and a porosity of at least 1.75 cc/grams;

(b) 0 to 55%, more preferably 5% to 50% of an alkali metal carbonate;

(c) 0 to 10%, more preferably 0.1% to 6% of a polyacrylate type polymer;

(d) 0 to 2%, more preferably 0.1% to 1% of an optical brightener;

(e) 0 to 10% of an anionic surfactant; and (f) 10% to 40% of an ethoxylated nonionic surfactant, wherein said ethoxylated nonionic surfactant is adsorbed on said zeolite and said alkali metal carbonate and the agglomerate composition has a minimum of 60% relative flowability.

The formulas referenced in this application and examples were made by mixing the appropriate components with the defined agglomerate compositions. Components could be added singularly or in part of whole in another pre-made composition. One method of combining a part or whole of the non-agglomerated components is through preparation of a spray dried base. A spray dried base can be made and added to the agglomeration composition. Additional components such as fragrance, enzymes, etc. were then added to this new mixed formulation.

The spray dried base referenced above was made via conventional methods. Materials were mixed in proper proportions, conditional, then dried to appropriate physical form. Conditions were controlled to yield a powder of appropriate chemistry, color, size, density, flow, etc. Chemical compositions of the dried composition comprising approximately by weight:

(a) 1.0% to 50% sodium sulfate;

(b) 1.0% to 70% sodium carbonate;

(c) 0.2% to 20%, preferably 0.2 to 10% of a sulfate or sulfonate anionic surfactant;

(d) 1.0% to 20% sodium silicate;

(e) 0.1% to 20% of a brightener;

(f) 0.5% to 10%, more preferably 1.0 to 5.0% of a polyacrylate type polymer;

(g) 0.1% to 5.0% moisture.

Bulk density could range from 0.30 to 0.75, more preferably 0.35 to 0.60 grams/cc.

Suitable anionic surfactants used in the instant compositions at less than 10 wt. % include the water-soluble alkali metal salts having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil; sodium and potassium alkyl ($C_9$–$C_{20}$) benzene sulfonates, particularly sodium linear secondary alkyl ($C_{10}$–$C_{15}$) benzene sulfonates; sodium alkyl glycerol ether sulfates, especially those ethers of the higher alcohols derived from tallow or coconut oil and synthetic alcohols derived from petroleum; sodium coconut oil fatty monoglyceride sulfates and sulfonates; sodium and potassium salts of sulfuric acid esters of higher ($C_8$–$C_{18}$) fatty alcohol-alkylene oxide, sulfates of methyl esters ($C_8$ –$C_{20}$) with $SO_3$ forming alpha sulfonate commonly known as alpha methyl sulfo esters of fatty acids and also particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulfonates such as those derived from reacting alpha-olefins ($C_8$–$C_{20}$) with sodium bisulfite and those derived from reacting paraffins with $SO_2$ and $Cl_2$ and then hydrolyzing with a base to produce a random sulfonate; and olefin sulfonates which term is used to describe the material made by reacting olefins, particularly $C_{10}$–$C_{20}$ alpha-olefins, with $SO_3$ and then neutralizing and hydrolyzing the reaction product. The preferred anionic surfactants are ($C_{10}$–$C_{18}$) alkyl polyethoxy (1–11 Eo) sulfates and mixtures thereof having differing water solubilities.

Suitable nonionic surfactants used in the instant compositions include, in particular, the reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic surfactant compounds are alkyl ($C_6$–$C_{18}$) primary or secondary linear or branched alcohols condensed with ethylene oxide, and products made by condensation of ethylene oxide with the reaction products of propylene oxide and ethylenediamine. [Other so-called nonionic surfactant compounds include long chain tertiary amine oxides, long-chain tertiary phosphine oxides, dialkyl sulfoxides, fatty ($C_8$–$C_{18}$) esters of glycerol, sorbitan and the like, alkyl polyglycosides, ethoxylated glycerol esters, ethyoxylated sorbitans and ethoxylated phosphate esters.]

The preferred non-ionic surfactant compounds are those of the ethoxylated and mixed ethyoxylated-propyloxylated ($C_{12}$–$C_{15}$), ($C_{12}$–$C_{14}$) ($C_{14}$–$C_{16}$) fatty alcohol or synthetic alcohol, containing 6 to 11 ethylene oxide (EO) groups.

The Zeolite MAP used in the instant compositions is defined as an alkali metal aluminosilicate of the zeolite P type having a two dimensional channel system and a silicon to aluminum ratio not greater than 1.33, preferably within the range of from 0.9 to 1.33, and more preferably within the range of 0.9 to 1.2 and having elliptical pore openings. Of especial interest is zeolite MAP having a silicon to aluminum ratio not greater than 1.15; and zeolite MAP having a silicon to aluminum ratio not greater than 1.07 is especially preferred. Although zeolite MAP like other zeolites contains water of hydration, for the purposes of the present invention amounts and percentages of zeolite are generally expressed in terms of the notional anhydrous material. The amount of water present in hydrated zeolite MAP at ambient temperature and humidity is normally about 20 wt. %. Zeolite MAP generally has a calcium binding capacity of at least 150 mg CaO per g of anhydrous aluminosilicate, as measured by the standard method described in GB1473201 (Henkel) and also described, as "Method I" in EP384070A (Unilever). The calcium binding capacity is normally at least 160 mg CaO/g and may be as high as 170 mg CaO/g. Zeolite MAP also generally has an "effective calcium binding capacity" measured as described under "Method II" in EP384070A (Unilever) of at least 145 mg CaO/g, preferably at least 150 mg CaO/g.

The zeolite MAP in the instant composition is used in conjunction with other inorganic or organic builders. Inorganic builders that may be present include the sodium carbonate. Organic builders that may be present include polycarboxylate polymers such as polyacrylates, acrylic/maleic copolymers, and acrylic phosphonates; monomeric polycarboxylates such as citrates, gluconates, oxydisuccinates, glycerol mono-, di- and trisuccinates, carboxymethyloxysuccinates, carboxymmethyloxymalonates, dipicolinates, hydroxyethyliminodiacetates, alkyl- and alkenylmalonates and succinates; and sulphonated fatty acid salts. This list is not intended to be exhaustive. Builders, both inorganic and organic, are preferably present in alkali metal salt, especially sodium salt, form.

The alkali metal silicate such as sodium or potassium silicate used in the instant compositions are generally added in the form of an aqueous solution, preferably having $Na_2O:SiO_2$ ratios of about 1:1.3 to about 1.28 and $K_2O:SiO_2$ ratios of about 1:2.0 to about 1:2.6.

The polyacrylate type polymer used in the instant compositions as a calcium sequestering agent is selected from the group consisting of a sodium or potassium salt of a copolymer of polyacrylic acid and maleic anhydride having a molecular weight of about 1,000 to about 5,000 such as Alco™ AR978 sold by Alco Chemical and Alcosperse™ 412 sold by Alco Chemical which is a terpolymer of polyacrylic acid, maleic anhydride and polyacrylamide. This terpolymer which has a molecular weight of about 1,000 to about 6,000 is characterized by the formula:

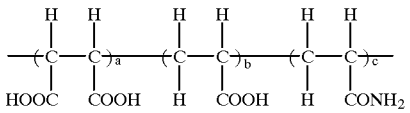

wherein a+b+c=1; a≧b+c; and c≦0.1

The detergent composition may also contain one or more enzymes which are active against biodegradable stains, e.g., starches, vegetable and blood, and which are also active at a pH of about 5 to about 12. Preferred enzymes which may be used include amylolytic enzymes (alpha amylases), alkaline and neutral proteases, lipolases, cellulases and the like, and mixtures thereof.

Alkaline or neutral proteolytic enzymes suitable for the present composition include the various commercial liquid enzyme preparations which have been adapted for use in detergent compositions. Enzyme preparations in powdered form are also useful although, as a general rule, less convenient for incorporation into a built liquid detergent composition. Thus, suitable liquid enzyme preparations include "Alcalase" and "Savinase", trademarked products sold by Novo Industries, Copenhagen, Denmark, and "Purafect" and "Properase" sold by Genencor, Rochester, N.Y.

Other suitable alpha-amylase liquid enzyme preparations are those sold by Novo Industries and Genencor under the tradenames "Termamyl" and "Purastar", respectively. Another enzyme preparation which may be used is a powdered enzyme preparation containing alpha-amylase and a mixture of alkaline and neutral proteases available as CRD-Protease from the Monsanto Co of St. Louis, Mo.

The enzymes are normally present in the detergent composition at a level of from about 0 up to about 3 wt. %, more preferably from about 0.05 to 1.5 wt. %.

The detergent composition may also contain one or more softening components known in the art. Suitable softeners include swelling bentonite clays such as sodium and calcium montmorillonites, sodium saponites and sodium hectorites. These may be present in the detergent composition at levels of from about 0.5 to 20 wt. %, more preferably from about 5 to 15 wt. %.

Other conventional materials may also be present in the liquid detergent compositions of the invention, for example, soil-suspending agent, silicon antifoaming agents and cationic antifoaming agents. Typical cationic antifoaming agents are dimethyl dialkyl ($C_{8-22}$) ammonium chloride, methyl benzyl dialkyl ($C_{12-18}$) ammonium chloride and $C_{12}$–$C_{22}$ alkyl trimethyl ammonium chloride and mixtures thereof. Typical silicon antifoaming agents are sold by Dow Corning are Q2-3302, 2-3485, 2-4248S and 2200. The composition can also contain sequesterants such as salts of ethylene diamine tetraacetic acid or analogous phosphonic acid salts, hydrotropes, corrosion inhibitors, dyes, perfumes, germicides, e.g., preservatives, e.g., quaternium 15, anti-tarnishing agents, buffers and the like. Such other conventional materials may be used in the amounts they are normally used generally up to about 5% by weight, more preferably up to about 3% by weight.

As necessary, pH modifiers, such as water soluble bases, e.g., NaOH, KOH, amines, or ammonia, will be added to obtain the desired pH level. The preferred pH will range from about 8 up to 11, more preferably from about 9 up to less than 11.

The instant compositions are made by an agglomeration process. In the agglomeration process, liquid components can be added to the powder components in several ways. In some cases, the entire liquid portion of the formulation can be added to the powder components in the agglomerator itself (Method 1). In other cases, some of the liquids can be pre-loaded on to a portion or all of the powder components before the final liquid constituents are added in the agglomerator device (Method 2). For this invention, both methods have been employed successfully. Method 2 is preferred.

Using the preferred methods, all or part of the nonionic surfactant mix is loaded onto either zeolite or a combination zeolite and sodium carbonate mix in a suitable liquid/solids mixing device. Examples of such mixing equipment are Ross mixers, Lodige, ribbon or paddle mixers, and Schugi contactors, etc. Surfactant loading can range from 0.1 to 80% of the powder weight. This step allows the surfactant material to be adsorbed by the powder material. Adsorption is a function of time, temperature, porosity, pore size, surfactant size, surface area, mixing energy and capillary action. After application of the surfactant, additional powder materials such as zeolite, sodium carbonate, or other type materials can be added to the mix. In addition, if the entire surfactant component was not initially added, part or all of the remaining surfactant component or other liquid compotents can be added at this time. The powder/surfactant mix is then mechanically or pneumatically conveyed to a small holding bin or directly into an agglomerator.

In the preferred method, the material is conveyed into a small bin. From this bin, the surfactant/zeolite/carbonate mix is metered and fed into a Schugi type agglomerator, In addition to the surfactant/zeolite/carbonate mix additional powder components can be added to the Schugi or other suitable agglomerator. Examples of such materials (not exclusive) are: brighteners and polymers. In the Schugi agglomerator, liquid polymers, of potentially differing types, and water are added as binders. These materials are added in the appropriate amount to generate the chemical composition and physical properties, i.e., particle size, desired.

From the Schugi agglormerator, the material is conveyed via mechanical device or by gravity to a fluid bed dryer. In this dryer, a combination of hot and cold air is used to dry and condition the material. From the fluid bed dryer, the free flowing material can be used as is or mixed with a variety of materials to form detergents of any composition. Examples of such materials are: detergent or detergent components made via the conventional spray dry process, enzymes, flow aids, perfumes or brighteners.

The detergent compositions of this invention are suitable for use as laundry detergents, dishwasher detergents, shampoos, body lotions and the like and may be modified by inclusion of specific known ingredients to accommodate these applications, e.g., dispersing agents, skin conditioning agents, antidandruff agents and the like.

The detergents of the invention are generally added to wash water at levels in the range of about 0.05 to 0.30 wt. %. For conventional washing machines; powder detergents are preferably used at levels of about 60 to 300 grams per load.

The following examples are illustrative of the invention.

EXAMPLE 1

The following zeolites were measured for moisture, particle size porosity and pore size.

Crosfield Zeolite Evolution

| | Moisture[1] | Particle size[2] | Porosity[3]/pore size[4] |
|---|---|---|---|
| Doucil A24 | 10% | 1.1 microns | 0.7999 cc/g-<250 nm |
| ZSE 144 | 20% | 2.9 microns | 2.0450 cc/g->1000 nm |
| ZSE 153 | 20% | 1.7 microns | |
| ZSE 148 | 20% | 2.4 microns | |
| ZSE 155 | 20% | 2.4 microns | 1.1928 cc/g - >700 nm |
| ZSE 156 | 20% | 2.8 microns | 1.1274 cc/g - >500 nm |

[1]moisture is measured at 250° C. on a Mitsubishi Moisture Meter which is an automatic Karl Titrator based on coulometric generation of iodine
[2]measured on a Sedigraph 5100
[3]porosity measured by mercury porosimetry
[4]pore size analyzed using a quanta chrome poremaster 60 mercury intrusion instrument

EXAMPLE 2

The following formulas were prepared by the previously defined agglomeration.

| | Pilot A | Pilot B | Pilot C | Pilot D | Plant E2 | Plant F2 |
|---|---|---|---|---|---|---|
| Nonionic | 20.04 | 20.04 | 20.04 | 20.04 | 26.44 | 26.44 |
| Sodium carbonate | 31.88 | 31.88 | 31.88 | 31.88 | 15.62 | 15.62 |
| Doucil A24 zeolite | 26.99 | | | | | |
| ZSE 144 zeolite | | 26.99 | | | | |
| ZSE 153 zeolite | | | 26.99 | | | |
| ZSE 148 zeolite | | | | 26.99 | | |
| ZSE 155 zeolite | | | | | 40.28 | |
| ZSE 156 zeolite | | | | | | 40.28 |
| Sodium polyacrylate | 23.52 | 3.52 | 3.52 | 3.52 | 3.52 | 3.52 |
| Optical brightener | 0.43 | 0.43 | 0.43 | 0.43 | 0.44 | 0.44 |
| Moisture | Bal | Bal | Bal | Bal | Bal | Bal |
| Relative flowability %[5] | | | | >70 | >70 | >70 |
| Particle size microns | >1 | | | $D_{50}$-900 | $D_{50}$-375 | $D_{50}$-375 |

The appearance of all the samples was a white powder.

5. relative flowability is:

$$\% \text{ relative flowability} \frac{\text{Effluent Time of Sand}}{\text{Effluent Time of Powder samples}} \times 100$$

wherein the effluent time is the amount of time for a two quart sample of the sand or powder to flow through a ⅝ inch nozzle at 25° C.

EXAMPLE 3

The following formulas were made in the fluid bed dryer by mixing the appropriate compotents with the agglomerate compositions of Example II.

| | A | B | C |
|---|---|---|---|
| Sodium linear alkyl benzene sulfonate | 1.4 | 1.4 | 1.4 |
| Nonionic surfactant 24-7 | 9.9 | 9.9 | 9.9 |
| Sodium carbonate | 35 | 35 | 35 |
| Doucil A24* | 15 | | |
| ZSE 144* | | 15 | |
| ZSE 156* | | | 15 |
| Sodium sulfate | 20.7 | 20.7 | 20.7 |
| Sodium polyacrylate | 2.5 | 2.5 | 2.5 |
| Sodium silicate | 5.0 | 5.0 | 5.0 |
| Protease Enzyme | 0.5 | 0.5 | 0.5 |
| Optical brightener | 0.3 | 0.3 | 0.3 |
| Fragrance | 0.4 | 0.4 | 0.4 |
| Moisture | Bal | Bal | Bak |
| Density grams/cc | 0.61 | 0.61 | 0.61 |

*Dry Bases

Detergent Studies
Top Loader (No Ballast, 10 minute wash)

| | Temp ° F. | Dose MI | Plant | Average Total L* |
|---|---|---|---|---|
| B | 60 | 92 | Pilot | 968 |
| B | 90 | 92 | Pilot | 998 |
| C | 60 | 92 | Pilot | 963 |
| C | 90 | 92 | Pilot | 989 |

-continued

| | Temp ° F. | Dose MI | Plant | Average Total L* |
|---|---|---|---|---|
| C | 60 | 160 | Plant | 998 |
| C | 90 | 160 | Plant | 1018 |

92 ml dose level represents the medium level and the 160 ml dose level represents the large level of the regular ultra scoop.

Foam Studies
Front Loader (18 minute wash)

| Product | Temp ° F. | Dose MI | Foam Height End of Wash | Foam Height End of Rinse | Average Total L* |
|---|---|---|---|---|---|
| B | 60 | 160 | 2.00" | 0.50 | 1060 |
| C | 60 | 160 | 3.00" | 0.5 | 1069 |
| C | 90 | 160 | 3.00" | 1.50 | 1063 |

Foam Studies
Top Loader (10 minute wash)

| Product | Temp ° F. | Dose MI | Foam Height End of Wash | Foam Height End of Rinse | Average Total L* |
|---|---|---|---|---|---|
| B | 60 | 160 | 2.25" | 2.25 | 1024 |
| C | 60 | 160 | 3.00" | 0.25 | 1036 |
| C | 90 | 160 | 1.50" | 0.13 | 1042 |

All washes for the foam study contained four pound ballast loads which included a set of the twelve stain multistain test swatches as a standard soil load. Front loader washes were run for eighteen minutes

What is claimed:

1. A cleaning composition comprising approximately by weight:

(a) 5% to 20% of an ethoxylated nonionic surfactant;

(b) 2.5% to 30% of a MAP zeolite which has a two dimensional channel system and has a silicone to aluminum weight ratio of less than 1.33 and having a particle size of 2.0 to 4.2 microns, said MAP zeolite being an agglomeration of crystallites having elliptical pore openings, a porosity of at least 1.1 cc/gram, a calcium binding capacity of at least 150 mg CaO per g of anhydrous aluminosilicate.

(c) 20% to 40% of a supplemental detergent builder salt;

(d) 0.5% to 5% of a polyacrylate type polymer wherein said polyacrylate polymer is a terpolymer of polyacrylamide, polyacrylic acid and maleic anhydride;

(e) 0.5% to 35% of a sodium sulfate; and (f) 0.5% to 7% of an alkali metal silicate.

2. The composition of claim 1 further including an anionic surfactant.

3. The composition of claim 1 further including at least one enzyme.

4. The composition of claim 3 wherein at least one of said enzyme is a proteolytic enzyme.

5. The composition of claim 4 wherein said supplemental detergent builder salt is sodium carbonate.

6. The composition of claim 5 wherein said ethoxylated nonionic surfactant contains 6 to 11 ethylene oxide groups.

7. The composition of claim 2 wherein said anionic surfactant is a sulfonate surfactant.

* * * * *